US005870023A

United States Patent [19]

Jackson

[11] Patent Number: 5,870,023

[45] Date of Patent: Feb. 9, 1999

[54] GOLF BAG ALARM

[76] Inventor: Gerald Lynwood Jackson, 13354 Lutz, Warren, Mich. 48093

[21] Appl. No.: 3,932

[22] Filed: Jan. 7, 1998

[51] Int. Cl.[6] ..... G08B 13/14

[52] U.S. Cl. ..... 340/568; 206/315.3; 340/571

[58] Field of Search ..... 340/568, 571, 340/687; 206/315.2, 315.3, 315.4; 200/61.19, 61.59

[56] References Cited

U.S. PATENT DOCUMENTS

| | | | |
|---|---|---|---|
| 4,042,918 | 8/1977 | Klitzman | 340/568 |
| 4,118,691 | 10/1978 | Sims | 340/548 X |
| 4,538,728 | 9/1985 | Lewis | 206/315.3 |
| 4,863,019 | 9/1989 | Lewis et al. | 206/315.3 |
| 4,955,472 | 9/1990 | Yamazoe | 206/315.6 |
| 5,028,909 | 7/1991 | Miller | 340/568 |
| 5,041,815 | 8/1991 | Newton | 340/568 |
| 5,194,856 | 3/1993 | Zijlstra | 340/568 X |
| 5,493,274 | 2/1996 | Long | 340/568 |
| 5,565,845 | 10/1996 | Hara | 340/568 |
| 5,582,043 | 12/1996 | McCue et al. | 70/58 |
| 5,590,772 | 1/1997 | Schuhlen et al. | 206/315.3 |
| 5,610,585 | 3/1997 | Jobe | 340/568 |

FOREIGN PATENT DOCUMENTS

| | | | |
|---|---|---|---|
| 2101783 | 1/1983 | United Kingdom | 340/571 |

*Primary Examiner*—Thomas J. Mullen, Jr.
*Attorney, Agent, or Firm*—Vanophem Meehan & Vanophem, P.C.

[57] ABSTRACT

A golf bag alarm that is removably attached to a golf bag. The alarm provides an audible signal when a club is removed from the bag, or the bag is removed from its resting place. Interconnecting straps run between the clubs and a pin on the alarm. When the pin is removed from the alarm, the alarm sounds an ear piercing signal. The interconnecting straps are fixed to a predetermined length that causes the pin to dislodge from the alarm, activating the alarm if any one of the clubs or the bag is moved any distance beyond the predetermined length of the interconnecting straps, thereby drawing attention to the attempted theft.

11 Claims, 1 Drawing Sheet

GOLF BAG ALARM

BACKGROUND OF INVENTION

1. Field of Invention

The present invention relates generally to anti-theft alarms. More particularly, the present invention relates to an alarm system for a golf bag triggered by an attempt to remove a golf club from the golf bag.

2. Description of Prior Art

The golf club securing devices of the prior art can be categorized into two areas; securing devices and indicating devices. Golf bag and club securing devices secure the individual clubs to the bag, or the bag to a stationary object. The indicating devices utilize an audible alarm or visual alarm to either deter theft or remind a golfer that a club has not been replaced in the bag.

Regarding the first area, securing devices, U.S. Pat. Nos. 4,863,019 to lewis et al. and 4,538,728 to Lewis each disclose a device for securing golf clubs within the golf bag. Both of these prior art references disclose a member that is attached to the open top of the golf bag that secures the clubs, preventing their removal from the bag. These devices do not include any provision for securing the bag to a stationary object. A thief can easily remove the entire bag, and use a bolt cutter, or similar device, to remove the securing device and access the clubs. Neither of these references utilizes an audible alarm.

Also categorized as a securing device is U.S. Pat. No. 5,582,043 to McCue et al. that discloses a clip member anchored to the golf bag. The anchoring structure has a lock assembly that has a strong cable wire for securing the bag to a stationary object. The golf bag and club securing device disclosed in McCue et al. further includes a cover comprising a flexible hood which extends over the open top of the golf bag. The hood has a chain enclosed in its hem. The chain engages with the lock assembly of the anchoring structure. The clubs are secured within the golf bag, and the golf bag is secured to a stationary object. However, no audible alarm is included in the system.

Similarly, U.S. Pat. No. 5,590,772 to Schuhlen et al. discloses a locking device that has a plurality of elongated shackles that lockingly receive the club shafts. Schuhlen et al. further disclose a cable that can be used to secure the locking device and golf bag to a stationary object. No audible alarm is included as a part of this system.

In each of the prior art references cited thus far, the devices fail to draw any attention to the bag giving the thief ample opportunity to conduct his business. The thief will have time to cut cables or pick a lock without any attention being drawn to his activities.

Referring now to the second area of prior art devices, the indicating devices, U.S. Pat. Nos. 5,041,815 to Newton and 5,493,274 to Long each disclose an audible alarm used in conjunction with a golf bag in order to deter theft of the bag or clubs therein. Newton discloses a switch housed in the bottom of the golf bag that will sense either weight or movement of the bag. In the weight sensitive embodiment, removing a single club from the bag will cause the alarm to sound. In the movement embodiment, the alarm is actuated when the bag is moved from its original resting position. The alarm works in the weight sensitive embodiment or the movement embodiment in the alternative depending on how it is set to operate.

U.S. Pat. No. 5,493,274 to Long discloses an alarm that is camouflaged as a golf club. The upper end of the alarm assembly resembles a club head. The siren is hidden in the false club head. A motion sensor and CPU are located further down the shaft of the false club and are hidden in the bag. The CPU will sound an audible alarm when the sensor detects movement of the bag. However, the alarm assembly takes up valuable bag space, eliminating room for playable clubs.

Other indication type golf bag alarm systems are directed to reminding a golfer to replace a club within his bag. These devices can be found in U.S. Pat. Nos. 5,028,909 to Miller, 4,042,918 to Klitzman, 5,565,845 to Hara, and 5,194,856 to Zijlstra. In particular, each of these devices senses and monitors individual clubs, providing a signal, either audible or visual, when a club is missing. Each of these devices is designed to be used during play to remind a golfer when he has forgotten to replace a club.

The devices mentioned above, other than the false club, are an integral part of the golf bag itself. The complex switches, sensors and processing units must be mounted within the golf bag to detect the presence or absence of a club and notify the golfer. Many golfers use more than one bag, i.e. one for carrying, and one for riding, depending on whether or not they are walking a course. In the references discussed above, the alarm is bag specific and not readily movable from one bag to another.

What is needed is an audible alarm system that will draw attention to the bag, and thereby draw attention to a thief who is attempting to remove a club from a bag, without the need for complicated switches and central processing units. The device must be simple enough to transfer from one bag to another so a golfer does not have to invest in expensive golf bag technology to attain the advantage of security for their golf clubs without taking up valuable space in the bag for playable clubs.

SUMMARY OF INVENTION

The present invention attempts to overcome the drawbacks associated with prior art golf club alarm devices. The present invention is a golf club alarm that can be easily moved from one bag to another, depending on the bag the golfer is using. The present invention is an audible alarm that draws attention to a thief who is attempting to remove a club from the bag, or the entire bag.

The present invention is an audible alarm that is activated by movement of a golf club, or the golf bag, in order to deter theft. The invention includes an alarm that is removably attached to the golf bag for easy transfer from one bag to another. The invention further includes individual head covers that cover the clubs, and are attached to the alarm by straps. When a thief attempts to remove a club from the bag, the strap connecting the club cover to the alarm releases a pin on the alarm which activates the alarm drawing attention to the thief preventing theft of the club. If the thief attempts to remove the club cover before removing the actual club, the same result applies.

It is also possible to provide a second pin on the alarm which has a strap attached to a fastener, such as a clip or a lock. The additional strap and fastener allows the golf bag to be attached to a stationary object and attempted removal of the bag will release the pin and activate the alarm, preventing theft of the entire bag.

It is an object of the present invention to provide an audible golf bag alarm.

It is another object of the present invention to provide an audible golf bag alarm that detects attempted removal of a club from a golf bag.

It is a further object of the present invention to provide a golf bag alarm that is portable and easily transferred from one golf bag to another in order to provide the golfer with the same security regardless of the bag chosen for play.

It is yet a further object of the present invention to provide a golf bag alarm that is capable of deterring theft of an individual club as well as an entire bag.

It is still a further object of the present invention to provide a golf bag alarm that is removably attached to the golf bag to allow a golfer to transfer the alarm from one bag to another.

It is yet another object of the present invention to provide a golf bag alarm that works in conjunction with standard club covers that are attached to the alarm mounted on the golf bag whereby movement of the club cover activates the audible alarm drawing attention to the bag and precluding theft.

Other advantages of the present invention will be more apparent from the following detailed description of the preferred embodiment taken in conjunction with the accompanying drawing.

DETAILED DESCRIPTION OF THE PREFERRED EMBODIMENT

Figure 1:
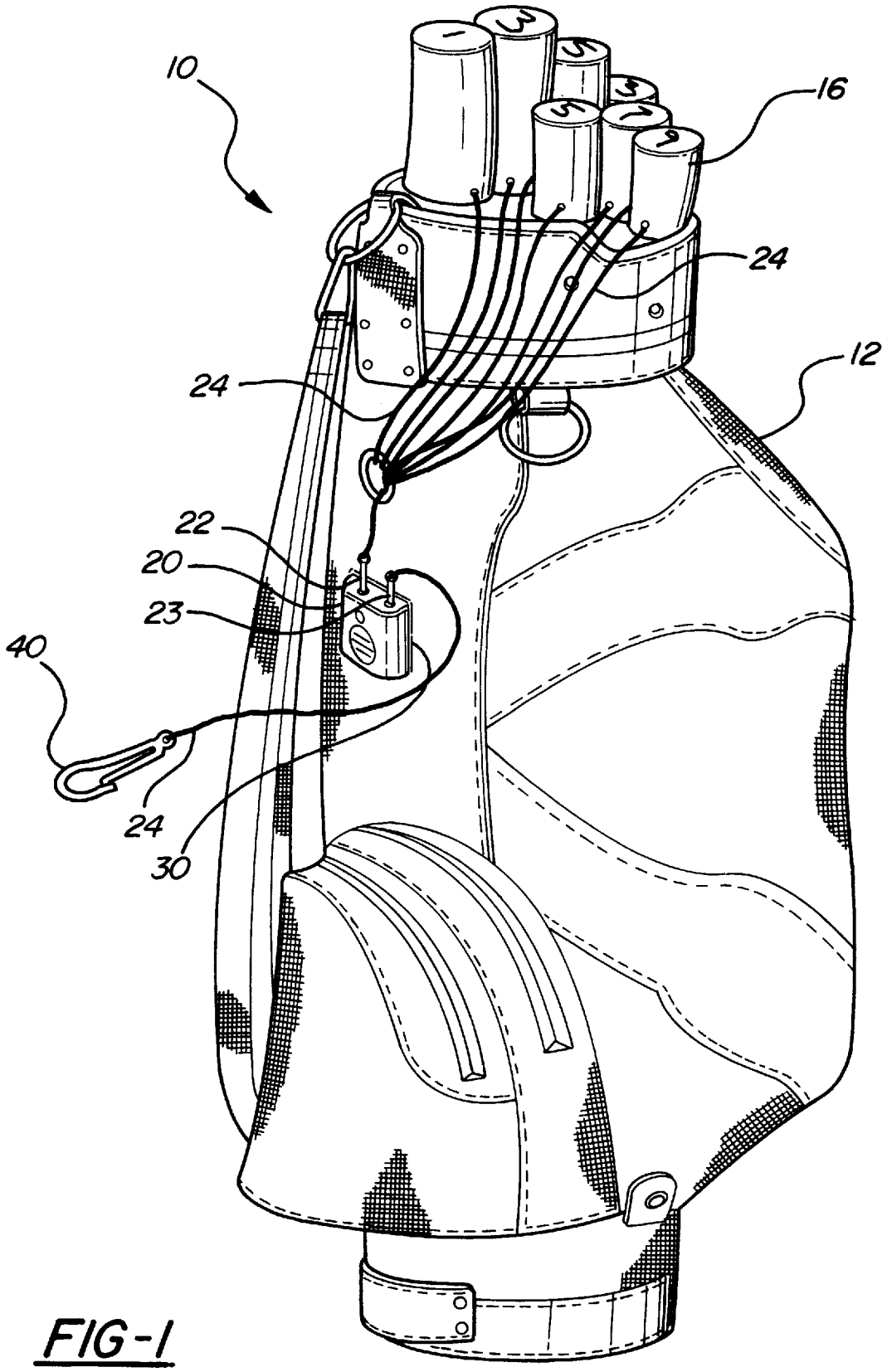
FIG. 1 is a view of a golf bag and golf clubs with the alarm device of the present invention assembled to the clubs and bag.

With reference to FIG. 1, a golf bag alarm assembly 10 of the present invention is shown assembled to a golf bag 12. Each of the individual clubs (not shown) contained within the golf bag 12 have club covers 16. The golf bag 12 can be of any type, make, model etc. and the golf bag alarm assembly 10 of the present invention can be used in conjunction with any golf bag 12 design. The individual clubs (not shown) and club covers 16 are also independent of the golf bag alarm assembly 10 of the present invention and the design and makeup of the clubs and club covers 16 have no effect on the golf bag alarm assembly 10.

The golf bag alarm assembly 10 of the present invention includes an alarm 20 removably attached to the golf bag 12. At least one pin 22 is removably attached to the alarm 20 and removal of the pin 22 from the alarm 20 activates an audible signal. At least one strap 24 extends between the alarm 20 and the individual club covers 16.

In general, the golf bag alarm assembly 10 is removably attached to the golf bag 12 by a fastener 30 such as a nylon hook and pile fastener commonly known as VELCRO®, or any other suitable fastener. The golf bag alarm assembly 10 is removably fastened to the golf bag 12 so that it can be easily transferred from one golf bag 12 to another depending on the golf bag 12 chosen by the golfer for play on a particular circumstance, for example, a bag suitable for riding in a cart as opposed to a lighter bag for carrying while walking the course.

The alarm 20 carries one portion of the fastener 30, for example the hook portion, and the opposing portion, or pile portion of the fastener 30 is attached to the golf bag 12. The same portion of a separate fastener 30 should be attached to each golf bag 12 that the golfer wishes to protect so that the alarm 20 can be easily removed from one and attached to any other golf bag 12 having the correct mating portion of the fastener 30 affixed thereto.

The alarm 20 is an audible signal alarm. In the preferred embodiment, the alarm 20 is the Personal Attack Alarm called the PAAL™ manufactured by Quorum International, Ltd., and is readily available at electronics supply stores.

The principle of the alarm 20 is to emit an ear piercing audible signal when activated. The alarm 20 is activated by removal of the pin 22.

A strap 24 is preferably connected between each of the club covers 16 and the pin 22. The strap 24 is a predetermined length such that when the club or club cover 16 is moved from its original position, the pin 22 is dislodged from the alarm 20 activating an audible signal, drawing attention to the golf bag 12.

In the preferred embodiment, the alarm is equipped with a second pin 23. A strap 24 is attached to the second pin 23 and has a fastener 40, such as a clip or lock, at the opposite end. The fastener 40 is capable of being attached to a stationary object. If the bag is moved from the stationary object, the second pin 23 will become dislodged activating the audible alarm, drawing attention to the bag and deterring theft.

In operation, the alarm 20 is attached to the golf bag 12. Individual straps 24 connect the pin 22 on the alarm 20 to the clubs. The straps 24 have a predetermined length and can be connected either directly to the club, or to the club covers 16. Additionally, the second pin 23 having the connecting strap 24 with the fastener 40 at one end allows the alarm 20 to protect the entire golf bag 12 in addition to each individual club. The fastener 40 is attached to a stationary object when the golf bag 12 is not being used.

The alarm 20 is activated when someone attempts to remove a club, club cover 16, or the entire golf bag 12. The predetermined length of the straps 24 will cause the pin 22 or the pin 23 to become dislodged from the alarm 20 if the golf bag 12 or its contents are removed from their resting place. Once at least one of the pins 22 and 23 is dislodged from the alarm 20 an ear piercing signal sounds drawing immediate attention to the bag and to the thief, thereby deterring theft.

While the invention has been set forth and described in terms of a preferred embodiment, it is apparent that other forms of the present invention can be adopted by one skilled in the art. Accordingly, the scope of the present invention is limited only by the following claims.

What is claimed is:

1. A golf bag alarm assembly for a golf bag having at least one golf club therein, said golf bag alarm assembly comprising:

at least one strap having a predetermined length, said at least one strap having a first end and a second end, said first end of said at least one strap being attached to said at least one golf club in said golf bag; and alarm means removably attached to said golf bag, said second end of said at least one strap being removably attached to said alarm means whereby said alarm means sounds an audible alarm in response to a movement of said at least one strap beyond a distance greater than said predetermined length of said at least one strap.

2. The golf bag alarm assembly of claim 1 wherein said alarm means further comprises a body portion and at least one pin removably attached to said body portion, said second end of said at least one strap being attached to said at least one pin, said audible alarm being activated when said at least one pin is removed from said body portion.

3. The golf bag alarm assembly of claim 2, wherein said first end of said at least one strap is attached to a club cover, said club cover positioned over said at least one golf club in said golf bag, such that any movement of said club cover beyond said predetermined length of said at least one strap will remove said at least one pin from said body portion and activate said alarm means.

4. The golf bag alarm assembly of claim 1 wherein said alarm means is removably attached to said golf bag by a nylon hook and pile fastener.

5. A golf bag alarm assembly for a golf bag having a plurality of clubs therein, said golf bag alarm assembly comprising:

a plurality of straps having a predetermined length, each of said plurality of straps having a first and second end, said first end of each of said plurality of straps being attached to each of said plurality of golf clubs; and alarm means removably attached to said golf bag, said second end of each of said plurality of straps being removably attached to said alarm means whereby said alarm means sounds an audible alarm in response to a movement of at least one of said plurality of straps.

6. The golf bag alarm assembly of claim 5, wherein said plurality of clubs in said golf bag each have a club cover, said first end of each of said plurality of straps is removably attached to said club covers for said plurality of golf clubs in said golf bag, whereby any movement of at least one of said club covers and at least one of said plurality of golf clubs will activate said alarm means.

7. The golf bag alarm assembly of claim 5 wherein said alarm means is removably attached to said golf bag by a nylon hook and pile fastener.

8. The golf bag alarm assembly of claim 5 wherein said second end of said plurality of straps is attached to a ring, said ring being removably secured to said alarm means.

9. A golf bag alarm assembly for a golf bag having at least one golf club therein, said golf bag alarm assembly comprising:

alarm means removably attached to said golf bag;

a first pin removably attached to said alarm means;

a second pin removably attached to said alarm means;

at least one club strap having a predetermined length, said at least one club strap having a first end and a second end, said first end of said at least one club strap connected to said first pin, said second end of said at least one club strap connected to said at least one golf club, said predetermined length of said at least one strap being such that said club cannot be removed from said golf bag without removing said first pin from said alarm means;

a bag strap having a predetermined length, said bag strap having a first end and a second end, said first end of said bag strap connected to said second pin, said predetermined length of said bag strap being such that said golf bag cannot be moved a distance greater than said predetermined length of said golf bag strap without removing said second pin from said alarm means; and a fastener attached to said second end of said bag strap; whereby said alarm means is activated when said first pin is removed from said alarm means by moving said at least one club strap a distance greater than said predetermined length of said at least one club strap and said alarm means is activated when said second pin is removed from said alarm means by moving said bag strap a distance greater than said predetermined length of said bag strap.

10. A golf bag alarm assembly as claimed in claim 9 wherein said golf bag alarm assembly further comprises at least one club cover having said second end of said at least one club strap attached thereto, said at least one club cover being positioned over said at least one golf club.

11. The golf bag alarm assembly of claim 9 wherein said alarm means is removably attached to said golf bag by a nylon hook and pile fastener.

* * * * *